US010006596B2

(12) United States Patent
Yu et al.

(10) Patent No.: US 10,006,596 B2
(45) Date of Patent: Jun. 26, 2018

(54) COLOR CHANGING LIGHT AND RELATED LIGHT CHAIN THEREOF

(71) Applicants: NINGBO WELL ELECTRIC APPLANCE CO., LTD., Ningbo (CN); WUHAN LUCKY PARTNERS CO., LTD., Wuhan (CN); HANGZHOU EBOYLAMP ELECTRONICS CO., LTD., Hangzhou (CN)

(72) Inventors: Guolin Yu, Ningbo (CN); Yaxun Li, Wuhan (CN); Genda Xu, Hangzhou (CN)

(73) Assignees: NINGBO WELL ELECTRIC APPLIANCE CO., LTD., Ningbo (CN); WUHAN LUCKY PARTNERS CO., LTD., Wuhan (CN); HANGZHOU EBOYLAMP ELECTRONICS CO., LTD., Hangzhou (CN)

( * ) Notice: Subject to any disclaimer, the term of this patent is extended or adjusted under 35 U.S.C. 154(b) by 103 days.

(21) Appl. No.: 15/225,746

(22) Filed: Aug. 1, 2016

(65) Prior Publication Data

US 2017/0343170 A1 Nov. 30, 2017

(30) Foreign Application Priority Data

May 27, 2016 (CN) ..... 2016 1 0368870

(51) Int. Cl.

| | |
|---|---|
| ***H01R 33/00*** | (2006.01) |
| ***F21S 4/20*** | (2016.01) |
| ***F21V 23/06*** | (2006.01) |

(52) U.S. Cl.

CPC ..... *F21S 4/20* (2016.01); *F21V 23/06* (2013.01)

(58) Field of Classification Search

CPC ..... F21Y 2105/10; F21Y 2101/00; F21Y 2103/10; F21V 23/06; F21V 19/0005; F21V 21/002

USPC ..... 362/647–659

See application file for complete search history.

(56) References Cited

U.S. PATENT DOCUMENTS

| | | | | |
|---|---|---|---|---|
| 5,420,482 A * | 5/1995 | Phares | ..... | H05B 37/029 315/292 |
| 8,616,757 B2 * | 12/2013 | Leadford | ..... | F21S 2/005 362/648 |
| 2005/0169015 A1 * | 8/2005 | Luk | ..... | F21V 3/00 362/648 |

* cited by examiner

*Primary Examiner* — William Carter

(74) *Attorney, Agent, or Firm* — Hemisphere Law, PLLC; Zhigang Ma

(57) ABSTRACT

The present invention discloses a color changing light and related light chain thereof. The color changing light comprises: connecting line group; a lampholder disposed on the connecting line group; a lighting module connected to the connecting line group; a bulb installed on the lampholder; the connecting line group comprises live wire, neutral wire and signal wire, the neutral wire extends to one end of the lampholder and connects to the lampholder, the live wire and the signal line respectively connect to two springs on the bottom of the lampholder; the lighting module is disposed separately with respect to the lampholder, the lighting module comprises a base matching the screw of the lampholder, a lighting object disposed inside the base, wherein the neutral wire of the lighting object is disposed on the base, the live wire and the signal wire extend outward with respect to the bottom of the base.

17 Claims, 4 Drawing Sheets

COLOR CHANGING LIGHT AND RELATED LIGHT CHAIN THEREOF

This application claims the priorities of Chinese patent application number 201610368870.3, filed on May 27, 2016, the entire contents of which are incorporated herein by reference.

FIELD OF THE DISCLOSURE

The present invention relates to outdoor lights, in particular, relates to a color changing light and relevant light chains.

BACKGROUND OF THE DISCLOSURE

Color changing light chain is one kind of outdoor lights, it is made up of a power extension line of a certain length and a plurality of color changing lights disposed on and electrically connected to the power extension line, wherein the color changing lights are interval disposed on the power line. In this way, during the use of the color changing light chain, each light can luminate as well as color changing, in order to gain a decorative effect.

As far as now, the existing color changing light chain usually only has live wire and neutral wire connected to the power extension line. The color changing control of the color changing light is mainly controlled by an encoder which controls the switching on and switching off the core wires of different colors to realize the color changing function. Specifically, if the color changing light needs to realize RGB color changing, then there are 5 core wires to connect the lighting module and the lampholder, i.e. two power wires plus 3 core wires for individually controlling the switching on and off of the red, green, blue light respectively, in the practical use, it is done by respective control of the switching on and off of the RGB core wires for the red, green, and blue light. The production of the color changing light is complicated, and the production efficiency and assembly efficiency are quite low; chaos is easy to occur between the encoder and the transmission of different color signal wires, and usually the connection of multiple threaded core wires can be made only by plug structure to achieve electrical connection, the connection is therefore not robust, and it is highly possible to encounter poor contact. Meanwhile, when using the color changing light chain, if a lighting module is damaged, it is difficult to replace the problematic color changing light, so it cannot satisfy the users' needs very well.

BRIEF DESCRIPTION OF THE DRAWINGS

In order to illustrate more clearly with prior arts or embodiment of the present invention, the figures needed to be used in the embodiments of the present invention or prior arts will be described briefly in the following section. It is noted that the figures described below only relate to some embodiments of the present invention. For ordinary person skilled in the art, some other drawings according to these drawings can be easily got without paying creative work.

DETAILED DESCRIPTION OF ILLUSTRATED EMBODIMENTS

To make the objectives, technical solutions, and advantages of the present invention clearer, the present invention is further described in detail in combination with specific embodiments and attached drawings. It should be understood that the embodiments described here are only exemplary ones for illustrating the present invention, and are not intended to limit the present invention.

Figure 1:
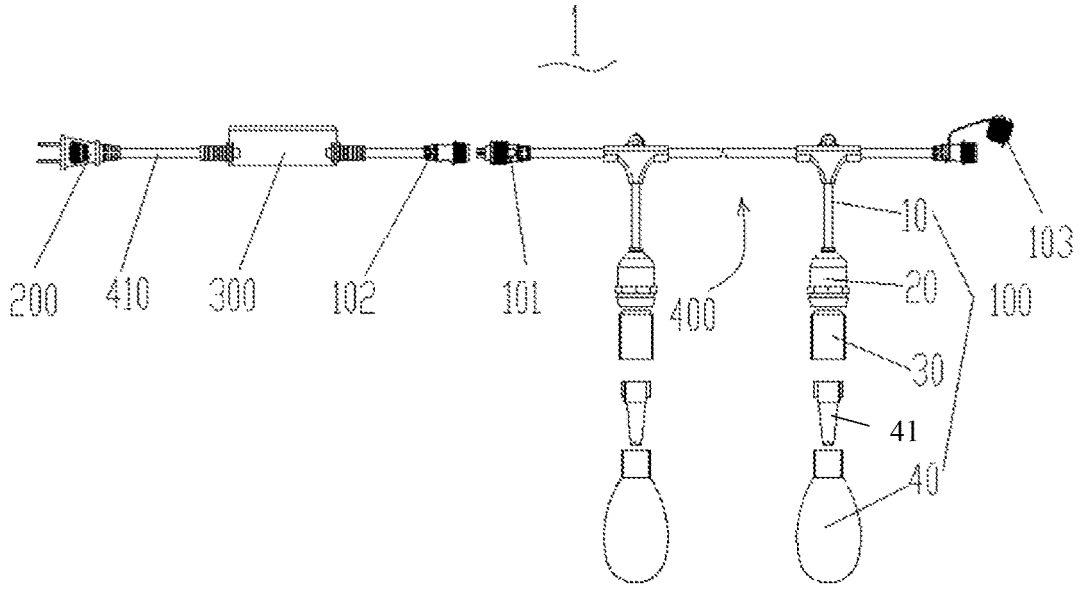
FIG. 1 is a block diagram of light chain according to an embodiment of the invention.
Figure 2:
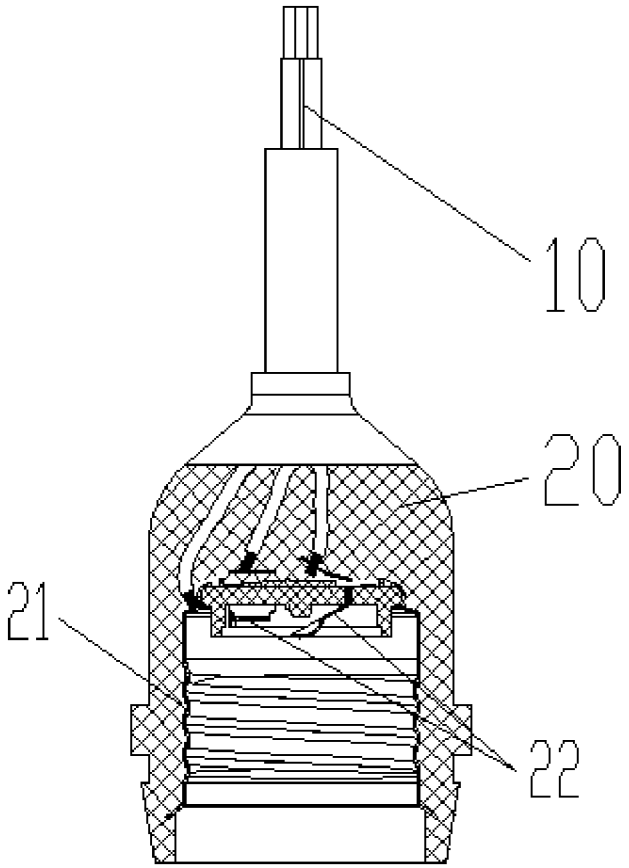
FIG. 2 is a sectional diagram of a lampholder according to an embodiment of the invention.
Figure 3:
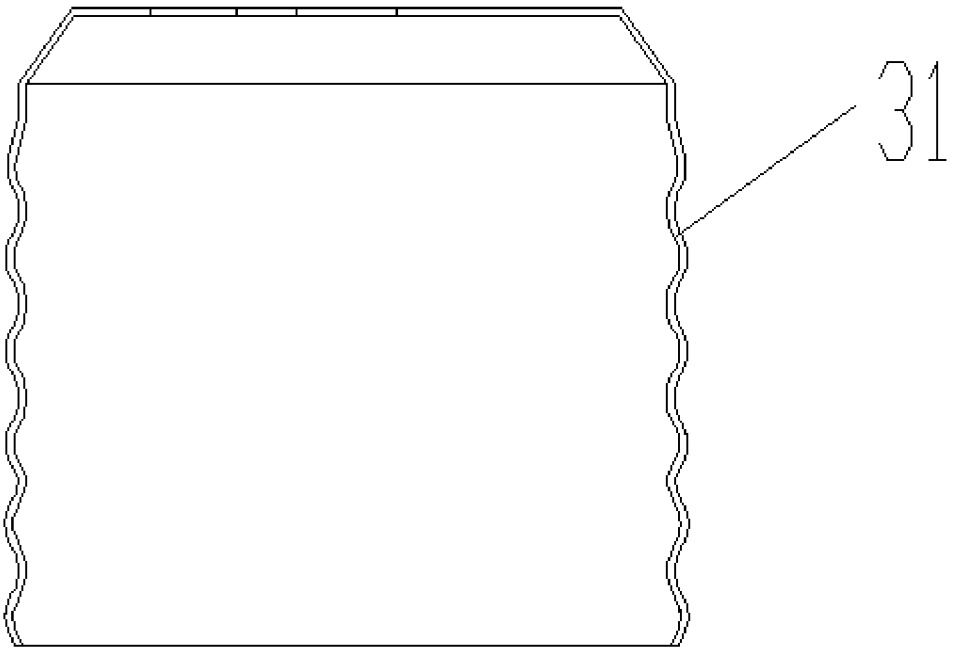
FIG. 3 is a block diagram of a base of the light chain of FIG. 1, according to an embodiment of the invention.
Figure 4:
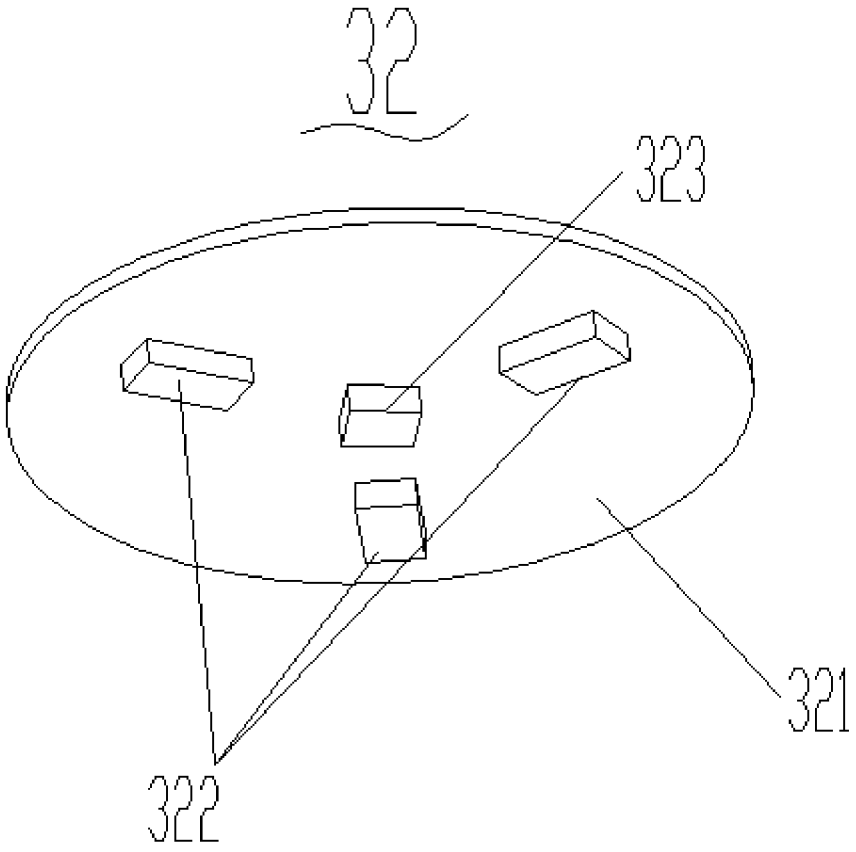
FIG. 4 is a block diagram of a lighting object of the light chain of FIG. 1, according to an embodiment of the invention.

Please refer to FIG. 1~FIG. 4. One embodiment of this invention provides a light chain 1, comprises power line group 410, socket unit 200 disposed on the power line group 410, controller 300 and a plurality of light chain units 400. It is understandable that, according to the length requirement of light chain 1, it can be adjusted by configuring the number of the light chain unit 400. In this embodiment, the light chain unit 400 comprises several color changing lights connected in sequence.

Wherein, the color changing light 100 comprises the connecting line group 10, lampholder 20 disposed on the connecting line group 10, the lighting modules 30 connected to the connecting line group 10 and the bulbs 40 installed on the lampholder 20.

It is understandable, when the color changing light 100 is assembled to the light chain 1, it is vertical disposed onto the power line group 410 via connecting line group 10, and the connecting line group 10 is electrically connected to the power line group 410, to induce the current of the power line group 410 to the color changing light 100 for work. Specifically, the connecting line group 10 includes three core wires: live wire, neutral wire and signal wire, wherein the signal wire is to control the changing of the color when the lighting module 30 is working. It is understandable, when configuring the power line group 410 of this embodiment, the power line group 410 between the socket unit 200 and the controller 300 is only made up of live wire and neutral wire. Wherein through the controller 300 and under the control of the controller 300, the neutral wire and the signal wire extends outwardly, such that when the color changing light 100 is working, the color changing is realized by the signal loop consisted of the signal wire and the neutral wire, and an encoder (not shown in the figure) configured in the controller 300 is equipped with software program to realize the color changing control of the lighting object 32. Specifically, a remoter is used to emit signals and the controller receives signals, and it is controlled under the signal transmission of the signal wire. In this embodiment, particularly, the color changing and the flash of RGB color of the lighting object 32 is achieved. Compared to the conventional color changing control method using 5 core wires, the approach in this embodiment reduces the number of core wires, and can simplify the production process, therefore realizes the divided structure between the lighting module 30 and the lampholder 20 by screw connection. Moreover, this embodiment uses signal wire for the signal transmission, this stabilizes the signal in transmission, and ensures the precise control of the color changing when the color changing light 100 is at work. Wherein, the neutral wire extends to a terminal of the lampholder 20 and connects to the screw 21 of the lampholder 20, and the live wire and the signal wire are respectively connected to the two springs 22 on the bottom of the lampholder 20. That is, the color changing light 100 of this embodiment can connect to the lighting module 30 through the screw 21 and the two springs of the lampholder 20, in order to realize the connection between the connecting line group 10 and the lighting module 30. The parts of live wire, the neutral wire and the signal wire which are extended outside the lampholder 20 are placed in a triangular fashion.

In this embodiment, the two springs 22 are made of copper, and the spring 22 to connect the lampholder 20 and the live wire is partially tilted upward with respect to the lampholder 20, to meet the assembly requirement of the lampholder 20 and the lighting module 30.

The lighting module 30 is the lighting source of the color changing light 100, the lighting module 30 receives the current from the connecting line group 10 and luminates on one side, on the other side, the lighting module 30 is controlled by the signal wire of the connecting line group 10 and realizes the color changing. The lighting module 30 of this embodiment is separately disposed from the lampholder 20, the lighting module 30 includes base 31 matching with the screw 21 of the lampholder 20, and includes a lighting object 32 disposed inside the base 31. Wherein the connecting line of the neutral wire of the lighting object 32 is disposed on the base 31, the connecting lines of the live wire and the signal wire are extended outward partially with respect to the base. In this way, when the lighting module 30 is assembled to the lampholder 20, the base 31 of the lighting module 30 can be screwed into the bottom of the lampholder 20. And when the base 31 is screwed into the bottom of the lampholder 20, the live wire and the signal wire on the base 31 will connect to the two springs 22 on the bottom of the lampholder 20, i.e. the live wire and the signal wire of the lighting module 30 are connected to the live wire and the signal wire in the connecting line group 10. It is understandable, because the lighting module 30 is screwed into the screw 21 of the lampholder 20 via base 31 to implement the assembly. Therefore, in one way, this ensures the connection between the neutral wire of the lighting module 30 and the screw 21 of the lampholder 20, i.e., ensures connection between the neutral wire and the neutral wire of the connecting line group 10; in another way, this ensures the connection between the live wire, neutral wire of the lighting module 30 and the two springs of the lampholder 20.

Wherein, the lighting object 32 includes substrate 321, RGB chip and white chip 323 are configured to be facing the bulb 40, to emit the light rays via the bulb 40 while working. In this embodiment, the RGB chip 322 is placed around the white chip 323 in a ring shape array. It is understandable, because lighting source of the color changing light 100 is made up of the RGB chip 322 and the white chip 323, so when the color changing light 100 is working, the RGB chip 322 can be turned off and the white chip 323 can be turn on when it is to emit white light. Compared with the conventional color changing light made up of only the RGB chip, the color changing light 100 of this embodiment can have a lower color temperature, thus produces a warm color effect, meanwhile, because only the white chip 323 is working, it consumes less power to meet users' needs.

It is understandable, the bulb 40 is specifically made of transparent plastic material, to emit the light when the lighting module 30 is working. In this embodiment, to enhance the effect of the color changing light 100, the color changing light 100 configures a light pipe 41 on the screw of the bulb 40, to emit the light of the working lighting module 30 in a stereo divergent manner, such that it can exhibit the stereo lighting effect when the color changing light 100 is in use. Wherein, an end of one side of the light pipe 41 is screw connected to the base 31 of the lighting module 30, the other side of the light pipe 40 is extended into the bulb 40 downwardly. In this embodiment, the bulb 40 is also screw connected to the base 31 of the lighting module 30. When configuring the light pipe 41, the screw of the light pipe 41 can abut to the screw of the bulb 40, and jointly form the structure to screw connect to base 31 of the lighting module 30.

In view of above, the color changing light and the relevant light chain of this invention, by configuring the lighting module and the lampholder to a screw-connected split structure, in this way, when manufacturing the color changing light, the lampholder and the lighting module can be modular produced separately, hence, the lighting module can be screwed into the lampholder, to complete the connection between the lighting module and the connecting line group of the lampholder. It is easy to assembly, improve the production efficiency, and during the use of the color changing light chain, any lighting module of the color changing light can be replaced individually, this helps the maintenance of the light chain. Also, this invention uses the signal loop made up of signal wire and neutral wire, and an encoder is applied to realize the color changing control, the operation process is easier, and more stable in the color changing control.

Described above are merely preferred embodiments of the present invention, but are not intended to limit the present invention. Any modification, equivalent replacement, or improvement made without departing from the spirit and principle of the present invention should fall within the protection scope of the present invention.

What is claimed is:

1. A color changing light, comprising:

a connecting line group;

at least one lampholder disposed on the connecting line group;

at least one lighting module connected to the connecting line group;

at least one bulb installed on the lampholder;

wherein, the connecting line group comprises live wire, neutral wire and signal wire, the neutral wire extends to one end of the lampholder and is connected to the lampholder, the live wire and the signal line are respectively connected to two springs on the bottom of the lampholder;

the lighting module is disposed separately with respect to the lampholder, the lighting module comprises a base screwed with the lampholder and a lighting object disposed inside the base, wherein the neutral wire of the lighting object is disposed on the base, the live wire and the signal wire extend outward with respect to the bottom of the base;

when the lighting module is screwed into the lampholder, the live wire and the signal wire of the base abut to the two springs on the bottom of the lampholder, to realize the connection between the lighting module and the connecting line group, wherein a light pipe is disposed on the screw of the bulb, an end of one side of the light pipe is screw connected to the base of the lighting module, the other side of the light pipe is extended downward into the bulb.

2. The color changing light of claim 1, wherein the springs used for connecting the live wire is partially tilted upward with respect to the bottom of the lampholder.

3. The color changing light of claim 1, wherein the bulb is screw connected to the base of the lighting module, and the screw of the light pipe is abutted to the screw of the bulb.

4. The color changing light of claim 3, wherein the lighting panel is contained inside the light pipe, the lighting object comprises substrate, RGB chip and white chip disposed on the substrate, the RGB chip and the white chip are disposed facing the bulb, to emit the light when working.

5. The color changing light of claim 4, wherein the RGB chip is disposed around the white chip in a ring shape array.

6. The color changing light of claim 1, wherein the parts of the live wire, the neutral wire and the signal wire that are extended outside the lampholder are placed in a triangular shape.

7. The color changing light of claim 1, wherein the two springs on the bottom of the lampholder are made of copper.

8. A light chain, comprising: power line group, socket unit disposed on the power line group, a controller and a plurality of light chain unit;

the light chain unit comprises a plurality of color changing lights connected in sequence, wherein each of the color changing lights is the color changing light comprises:

a connecting line group;

at least one lampholder disposed on the connecting line group;

at least one lighting module connected to the connecting line group;

at least one bulb installed on the lampholder;

wherein, the connecting line group comprises live wire, neutral wire and signal wire, the neutral wire extends to one end of the lampholder and is connected to the lampholder, the live wire and the signal line are respectively connected to two springs on the bottom of the lampholder;

the lighting module is disposed separately with respect to the lampholder, the lighting module comprises a base screwed with the lampholder and a lighting object disposed inside the base, wherein the neutral wire of the lighting object is disposed on the base, the live wire and the signal wire extend outward with respect to the bottom of the base;

when the lighting module is screwed into the lampholder, the live wire and the signal wire of the base abut to the two springs on the bottom of the lampholder, to realize the connection between the lighting module and the connecting line group, wherein a light pipe is disposed on the screw of the bulb, an end of one side of the light pipe is screw connected to the base of the lighting module, the other side of the light pipe is extended downward into the bulb.

9. The light chain of claim 8, wherein the controller is configured with an encoder, to realize color changing control of the lighting object via the signal line.

10. The light chain of claim 9, wherein each of the color changing lights comprising:

a connecting line group;

at least one lampholder disposed on the connecting line group;

at least one lighting module connected to the connecting line group;

at least one bulb installed on the lampholder;

the connecting line group comprises live wire, neutral wire and signal wire, the neutral wire extends to one end of the lampholder and connects to the screw of the lampholder, the live wire and the signal line respectively connect to two springs on the bottom of the lampholder;

the lighting module is disposed separately with respect to the lampholder, the lighting module comprises a base matching the screw of the lampholder, a lighting object disposed inside the base, wherein the neutral wire of the lighting object is disposed on the base, the live wire and the signal wire extend outward with respect to the bottom of the base;

when the lighting module is screwed into the lampholder, the live wire and the signal wire of the base abut to the two springs on the bottom of the lampholder, to realize the connection between the lighting module and the connecting line group.

11. The light chain of claim 10, wherein the springs used for connecting the live wire is partially tilted upward with respect to the bottom of the lampholder.

12. The light chain of claim 10, wherein a light pipe is disposed on the screw of the bulb, an end of one side of the light pipe is screw connected to the base of the lighting module, the other side of the light pipe is extended downward into the bulb.

13. The light chain of claim 12, wherein the bulb is screw connected to the base of the lighting module, and the screw of the light pipe is abutted to the screw of the bulb.

14. The light chain of claim 13, wherein the lighting panel is contained inside the light pipe, the lighting object comprises substrate, RGB chip and white chip disposed on the substrate, the RGB chip and the white chip are disposed facing the bulb, to emit the light when working.

15. The light chain of claim 14, wherein the RGB chip is disposed around the white chip in a ring shape array.

16. The light chain of claim 10, wherein the parts of the live wire, the neutral wire and the signal wire that are extended outside the lampholder are placed in a triangular shape.

17. The light chain of claim 10, wherein the two springs on the bottom of the lampholder are made of copper.

* * * * *